United States Patent [19]

Pharr

[11] 4,095,337

[45] Jun. 20, 1978

[54] FINGER ACTUATOR FOR FOLDED KNIFE BLADE

[76] Inventor: Cecil O. Pharr, 2272 La Vista Woods Dr., Atlanta, Ga. 30084

[21] Appl. No.: 751,796

[22] Filed: Dec. 17, 1976

[51] Int. Cl.[2] ..... B26B 1/02

[52] U.S. Cl. ..... 30/158

[58] Field of Search ..... 30/155, 164, 295, 158

[56] References Cited

U.S. PATENT DOCUMENTS

| | | | |
|---|---|---|---|
| 174,289 | 2/1876 | Peirce | 30/155 |
| 431,584 | 7/1890 | Holland | 30/155 |
| 847,474 | 5/1907 | Hawley | 30/158 |
| 1,750,577 | 3/1930 | De Bracht | 30/295 |

FOREIGN PATENT DOCUMENTS

| | | | |
|---|---|---|---|
| 5,613 of | 1892 | United Kingdom | 30/158 |

*Primary Examiner*—Jimmy C. Peters
*Attorney, Agent, or Firm*—Patrick F. Henry

[57] ABSTRACT

A finger actuator is provided for attachment on a conventional knife blade of the sort which is folded into the handle when not in use. The actuator comprises a resilient tool steel saddle arrangement fitted very tightly over the knife blade. A first plate extends upwardly from said saddle in a direction away from the edge of the knife blade and then extends outwardly in a direction substantially transverse to the longitudinal axis of the knife blade to provide a flat plate area against which the thumb pushes to open the blade while the other fingers of the hand hold the handle in the palm.

2 Claims, 5 Drawing Figures

FINGER ACTUATOR FOR FOLDED KNIFE BLADE

BACKGROUND OF THE INVENTION

1. Field of the Invention

Knives and knife blades and actuating devices therefor. Folding knives having blades pivoted to the handle.

2. Description of the Prior Art

The prior art would include so-called switch blade knives that are illegal in most places and which comprise a knife handle having a knife blade pivoted thereon with some sort of spring means interposed between the blade and the handle and a quick actuating finger latch mechanism to release the blade thereby permitting the spring to snap the blade into open position. In addition, there are the usual grooves or notches in knife blades to be grasped by the fingers to open the blade on the handle. These arrangements are not suitable for use by hunters, workmen, sailors, and the like who must use one hand for holding the article or for holding onto a tree or the like and thereby leaving free only one other hand to open a folded knife blade. The present device provides a small actuator which is fitted over the knife blade and left in place so that the blade may be readily opened by the thumb manipulation of one hand.

SUMMARY OF THE INVENTION

In an actuating device for attachment to the blade of a knife which comprises a knife handle on which the blade is pivoted: a means for attaching said actuator in place on the knife blade, and plate means extending from said knife blade and against which the thumb may be positioned and pushed while the rest of the fingers of the hand hold the handle in place in order to open the blade on the handle with only one hand.

An object of this invention is to provide a small actuator of the type mentioned above which is relatively inexpensive and is easy to position in place, leave on the blade or remove therefrom.

A further object of this invention resides in the particular construction of the actuator which in one form may comprise a substantially U-shaped saddle arrangement which is forced apart to be tightly fitted over the blade and from which is bent a small metal plate to provide the thumb actuating surface.

An additional advantage of this invention is found in the construction whereby the device may be manufactured substantially from a flat piece of high quality resilient steel to provide the means for attaching to the blade as well as the plate against which the thumb is operated.

Another advantage of this device resides in the arrangement and means by which the actuator is positioned on the blade so that it may be moved toward or away from the pivot point of the blade to locate and establish the best point of application of force for the swiftest and easiest opening of the particular blade on a particular knife.

Still another object of the present invention is found in the arrangement whereby the actuator does not interfere with the safety or operation or legality of the knife in any way during its normal storage position or in its normal open position.

Other and further objects and advantages of the present invention will become apparent upon reading the following specifications taken in conjunction with the accompanying drawings.

BRIEF DESCRIPTION OF THE PREFERRED EMBODIMENTS

Figure 1:
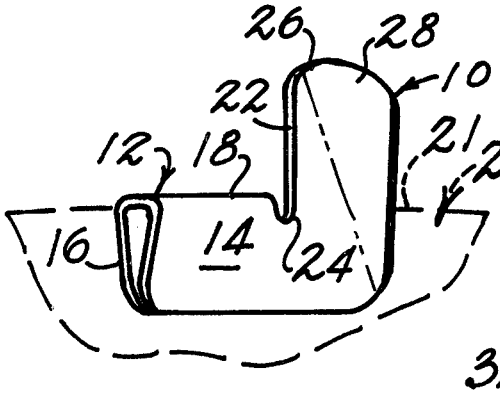
FIG. 1 is a perspective view of the knife actuator of the present invention shown in place on a blade illustrated in dotted lines.
Figure 4:
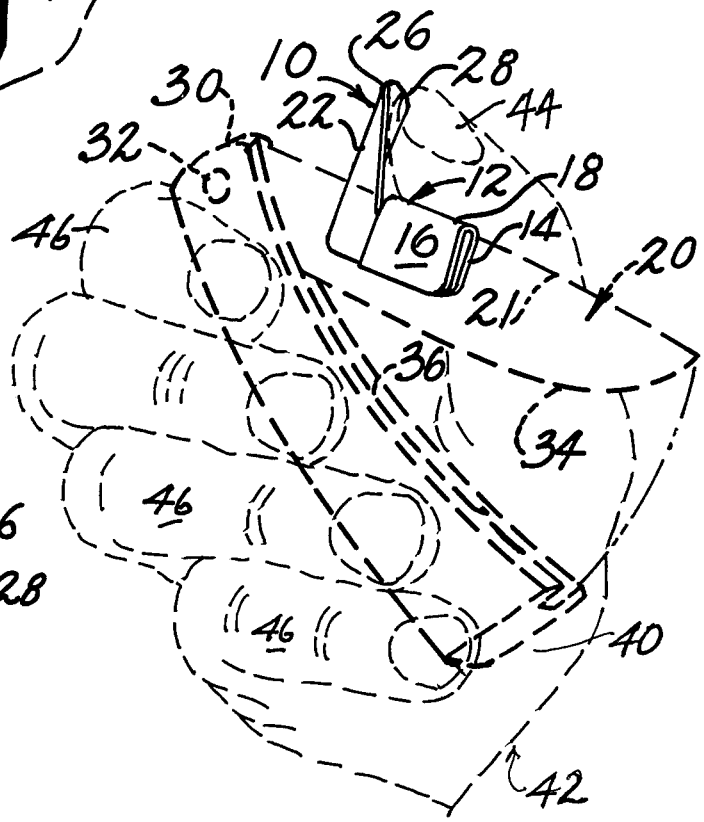
FIG. 4 is a perspective view of the actuator of FIG. 1 being operated to open the blade of the knife shown in dotted lines and held in the hand which is also shown in dotted lines.
Figures 2, 3:
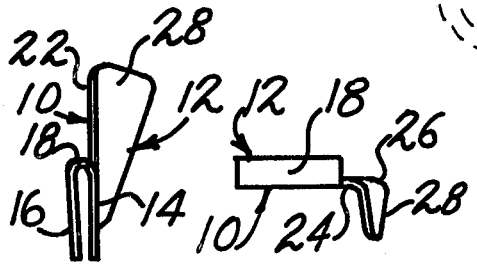
FIG. 2 is an end elevation view of the actuator shown in FIG. 1.
FIG. 3 is a top plan view looking down on the actuator shown in FIG. 1.
Figure 5:
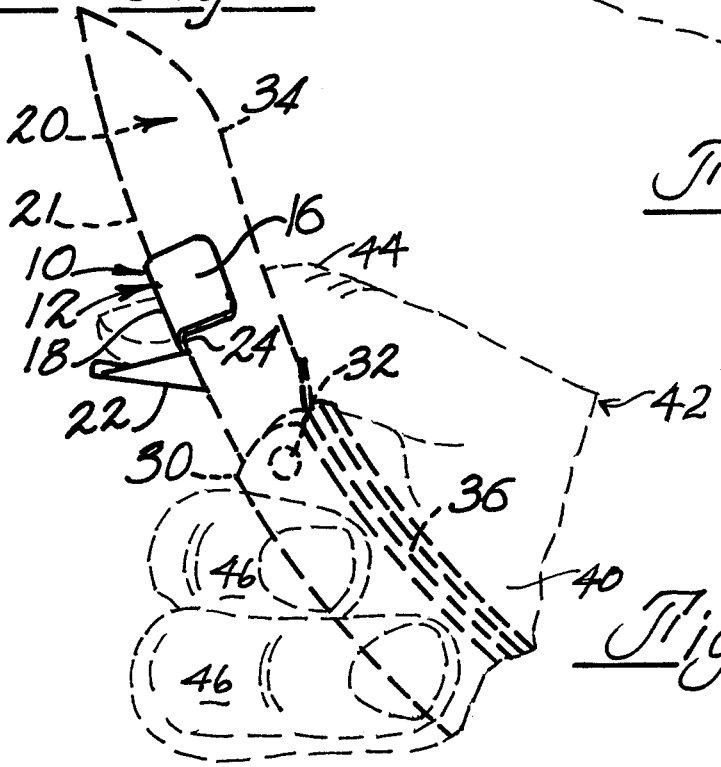
FIG. 5 is a perspective view similar to FIG. 4 illustrating the final position of the opening of the knife blade by means of the thumb, the hand and the other fingers.

A preferred embodiment designated generally by reference numeral 10 has a means for mounting identified generally by reference numeral 12 and which comprises a U-shaped pair of plates 14, 16 connected about a common portion 18 which fits over a conventional knife blade 20, in dotted lines in FIG. 1, 4 and 5. The entire device and particularly the U-shaped attaching means 12 may be manufactured from high quality tool steel such as spring steel and the like and as seen in FIG. 2 the plates 14, 16 are spread apart from normal closer position so as to require the spreading and springing apart thereof in order to position and attach the entire device 10 in place on the knife blade 20 top edge 21 in the manner shown in FIGS. 1, 4 and 5. An upwardly extending plate portion 22 is separated by notch 24 from edge 18 and extends upwardly in a direction away from the edge of the knife blade 20 and bends to provide a curved portion 26 which then extends into a transverse actuating plate portion 28 which extends substantially perpendicular to the plane of the face of the knife blade 20.

Knife blade 20 is mounted in the usual conventional fashion on a knife handle 30 by means of a pivot pin 32 and the sharp edge 34 of the blade folds into the groove 36 provided in handle 30 and for use of course the knife blade 20 is caused to pivot about the pivot pin 32 into the extended position shown in FIG. 5. The knife blade 20 is latched in place by a spring cam arrangement of common struction in the knife art which per se is not shown and does not form any claimed part of the present invention.

In the operation of the device 10 depending upon the characteristics of the knife handle 30 and the knife blade 20 such as the length and width and weight thereof, the plates 14, 16 are sprung apart slightly and the saddle 12 is first forced over the upper outer edge 21 of the knife blade 20 in place as shown in FIGS. 1, 4 and 5. The particular distance of the actuator 28 from pivot 32 could be computed and marked but is easily located more or less by trial and error by sliding the device 10 in very small increments either toward or away from the pivot pin 32 until the best mode of operation is achieved whereby the smoothest opening and closing of the blade 20 takes place. The usual manner of operation is to hold the knife handle 30 in the palm 40 of the hand 42 in the manner shown in FIG. 4 so that the thumb 44 has the end thereof flatly against the flat surface of the actuator plate 28 while the other fingers 46 of the hand are wrapped around the knife handle to hold it tightly in place against the palm. Thus, it is possible to remove the knife from the pocket, or from a leather sheath or the like in which such knives are normally carried, with only the one hand 42 and to open the blade 20 in one smooth swift action from the position shown in FIG. 4 to th position shown in FIG. 5 in which position the knife blade 20 is locked in place co-extensive with the handle 32 for normal use. This makes it possible for the user to continue to use the other hand as for example, for holding onto a tree, for holding onto a deer or some other animal while dressing same, or for holding lines on a sailboat. In an emergency situation, as for example where a rope may suddenly trap one arm of a rope handler or climber it is possible to use the other arm to remove the knife and cut the rope or perform some other operation with the knife. Industrial workers may use the knife to cut materials in machines.

The device has been shown in FIGS. 4 and 5 for use by the right hand which is suitable in a particular instance either for a righthanded or a lefthanded person. If desired, however, the device may be reversed on the knife and used by the left hand or of course the device could be made both in right and left hand versions depending upon the direction of the extension of the plate 28 either to the right or left as shown in FIG. 2. Also, obviously the device 10 can be attached to the blade 20 by means of small pins driven thru the device 10 and the blade 20, by spot welding or other means of attachment.

While I have shown and described a particular embodiment of this invention this is by way of illustration only and does not constitute any sort of limitation on the scope there of since there are various alterations, changes, deviations, eliminations, substitutions, revisions and departures which may be made in the particular preferred embodiment without avoiding the scope of the invention as defined only by a proper interpretation of the appended claims.

What is claimed:

1. In a knife actuator for a folding knife having a handle and a blade folded thereon for movement from a folded position to an extended position, said blade having a cutting and a non-cutting edge, said knife actuator comprising:

a pair of resilient, spring attaching plates attached along a common line which is positioned substantially co-extensively with and for attachment to the non-cutting edge of the blade, actuating means on said attaching plates comprising a first member extending upwardly on one side of said knife blade and said first member then bending outwardly substantially perpendicular to th knife blade providing a flat finger plate for operating said blade by pushing said plate with the thumb while holding said knife in the same hand as the thumb, said attaching plates being mounted by being manually urged apart against spring action in order to position same over said knife blade whereupon after release said plates spring tightly into place thereby holding said plates firmly in place on said blade, and said plates being manually slidable on said blade to adjust same.

2. The device claimed in claim 1 wherein said first member is tapered from top to bottom at the outer edge thereby extending closely adjacent one side of the blade.

* * * * *